US008025192B2

(12) United States Patent
Petzl et al.

(10) Patent No.: US 8,025,192 B2
(45) Date of Patent: Sep. 27, 2011

(54) ROPING BELT EQUIPPED WITH AN IMPROVED EQUIPMENT-CARRYING DEVICE

(75) Inventors: Paul Petzl, Barraux (FR); Jean-Marc Hedé, Domène (FR)

(73) Assignee: Zedel, Crolles (FR)

( * ) Notice: Subject to any disclaimer, the term of this patent is extended or adjusted under 35 U.S.C. 154(b) by 796 days.

(21) Appl. No.: 11/541,645

(22) Filed: Oct. 3, 2006

(65) Prior Publication Data

US 2007/0095873 A1 May 3, 2007

(30) Foreign Application Priority Data

Oct. 14, 2005 (FR) ..... 05 10506

(51) Int. Cl.

| | |
|---|---|
| ***A45C 1/04*** | (2006.01) |
| ***A45C 13/36*** | (2006.01) |
| ***A45F 3/00*** | (2006.01) |
| ***A62B 35/00*** | (2006.01) |
| ***A62B 1/16*** | (2006.01) |

(52) U.S. Cl. ..... 224/223; 224/660; 224/682; 224/684; 224/231; 119/857; 182/6

(58) Field of Classification Search ..... 224/223, 224/682, 684, 231, 931; 119/857; 182/6, 182/3

See application file for complete search history.

(56) References Cited

U.S. PATENT DOCUMENTS

| | | | | |
|---|---|---|---|---|
| 4,449,654 | A * | 5/1984 | Cappis | 224/148.6 |
| 5,370,288 | A * | 12/1994 | Field | 224/223 |
| 5,445,114 | A * | 8/1995 | Walker | 119/857 |
| 6,050,364 | A * | 4/2000 | Popall et al. | 182/6 |
| 7,100,810 | B1 * | 9/2006 | Bosch et al. | 224/682 |
| D558,402 | S * | 12/2007 | Petzl et al. | D29/101.1 |
| 7,445,085 | B2 * | 11/2008 | Petzl et al. | 182/6 |

* cited by examiner

*Primary Examiner* — Justin Larson
*Assistant Examiner* — Lester L Vanterpool
(74) *Attorney, Agent, or Firm* — Oliff & Berridge, PLC

(57) ABSTRACT

A roping belt comprises a lining structure, and an equipment-carrying device achieved by means of a continuous cord fixed by seams along the lining structure forming a succession of attachment loops. The ends of the cord are securedly attached to the belt by first end seams able to withstand higher forces than those of the second intermediate seams forming the attachment loops.

7 Claims, 3 Drawing Sheets

ROPING BELT EQUIPPED WITH AN IMPROVED EQUIPMENT-CARRYING DEVICE

BACKGROUND OF THE INVENTION

The invention relates to a roping belt comprising a lining structure, an equipment-carrying device, and attachment means arranged at the front of the belt. The equipment-carrying device is formed by a plurality of loops for hooking-on all sorts of equipment, in particular karabiners, descenders, jammers, pitons and such like. The belt is generally integrated in a harness used for rock-climbing, mountaineering, or working at a height.

STATE OF THE ART

According to the document U.S. Pat. No. 5,445,114, the equipment-carrying device of a harness is achieved by means of a continuous cord fixed by seams along the lining structure forming a succession of attachment loops.

Formation of the loop is achieved by means of several pieces of cloth of rectangular shapes sewn onto the belt and at the same time forming pockets. Such a belt is complicated and costly to manufacture.

It is also known to achieve the equipment-carrying device of a roping belt or harness by means of fractionated straps securedly attached individually along the belt. For safety reasons, each strap has to be fixed to the belt by means of very solid seams. Each strap thus has a high individual strength, but to the detriment of the weight and the manufacturing cost.

OBJECT OF THE INVENTION

The object of the invention is to achieve a light roping belt equipped with an equipment-carrying device with a high mechanical strength, and with a reduced manufacturing cost.

The belt according to the invention is characterized in that the ends of the cord are securedly attached to the belt by first end seams able to withstand greater forces than those of the second intermediate seams forming the attachment loops.

In case of incorrect use of the roping belt, for example if the person inadvertently hooks onto the equipment-carrying device cord instead of the main attachment loop, the strength of the first end seams is calculated to support the weight of a man in case of a dynamic fall. The equipment-carrying device cord remains attached to the belt via the first end seams, and safety is thus guaranteed even after the second intermediate seams have been torn by the effect of the shock.

The second intermediate seams are less solid than the first end seams as they merely have to keep the equipment hooked onto the loops. Implementation of these second intermediate seams is thus quicker than in the case of fractionated straps.

Other technical features of the invention can be used either alone or in combination:

- the cord of the equipment-carrying device is securedly attached by the seams to a continuous fixing webbing extending over the whole length of the lining structure strengthened by biases;
- the cord of the equipment-carrying device is connected to the end seams by attaching two ends of a discontinuous webbing with the attachment means;
- the intermediate seams of the cord are arranged on the lining structure;
- the series connection of two successive loops of the equipment-carrying device is fixed either under the seam of the biases at the level of the top edge of the belt or passes over the biases of the top edge.

BRIEF DESCRIPTION OF THE DRAWINGS

Other advantages and features of the invention will become more clearly apparent from the following description of an embodiment of the invention given as a non-restrictive example only and represented in the accompanying drawings, in which.

DETAILED DESCRIPTION OF PREFERRED EMBODIMENTS

Figure 1:
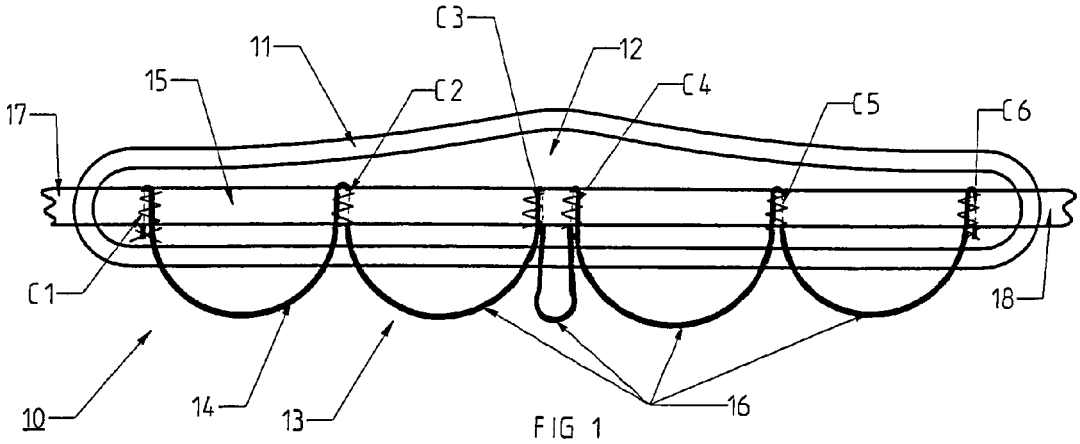
FIG. 1 shows an enlarged scale developed view of the belt equipped with the equipment-carrying device according to the invention.

With reference to FIG. 1, a roping belt 10, in particular for a rock-climbing harness, is formed by strengthening biases 11 sewn edgewise along the periphery of an internal lining structure 12.

The lining structure 12 can be formed for example by a netting, a close-meshed aired synthetic fabric, or a foam-based padded lining.

The belt 10 is equipped with an equipment-carrying device 13 on which the user hooks the equipment required for safety, in particular karabiners, descenders, jammers, etc.

The equipment-carrying device 13 is achieved by means of a continuous cord 14 fixed along a fixing webbing 15 forming a succession of U-shaped loops for attaching equipment. The webbing 15 is securedly attached to the lining structure 12 by the different seams C1, C2, C3, C4, C5, C6 for forming the loops 16 of the cord 14. The opposite ends 17, 18 of the webbing 15 are secured to the main attachment ring (not shown) of the harness.

The mechanical strength of the first end seams C1 and C6 is greater than that of the second intermediate seams C2 to C5 forming the different loops 16 joined in series.

In the even of an overload on the cord following a handling error, the first end seams C1 and C6 are calculated to withstand a very high tearing force, in particular greater than 4 kN. The cord 14 of the equipment-carrying device 13 remains attached to the belt at the locations of the first end seams C1 and C6, and safety is thus guaranteed up to this triggering threshold, even if the second intermediate seams C2 to C5 tear under the effect of the shock.

Figure 2:
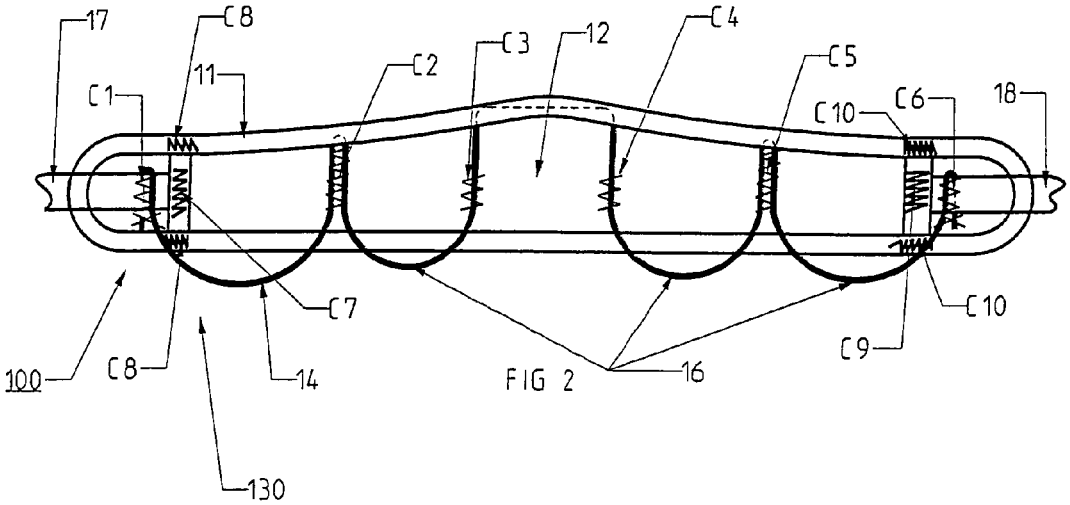
FIGS. 2 to 4 are identical views to FIG. 1 of different alternative embodiments.
Figure 3:
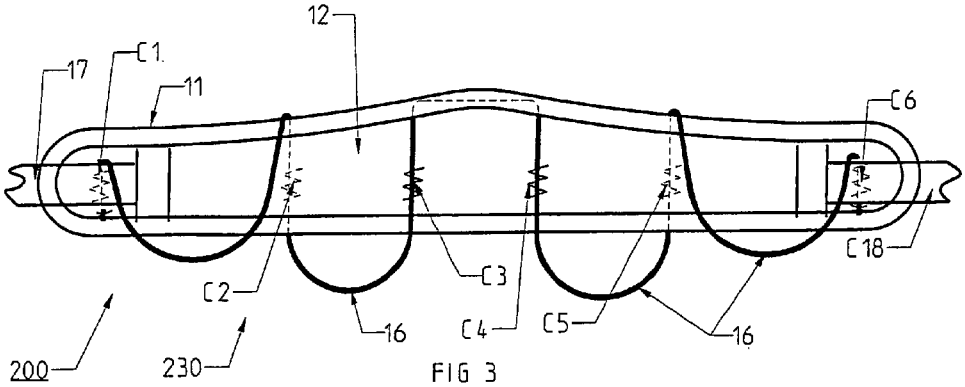
Figure 4:
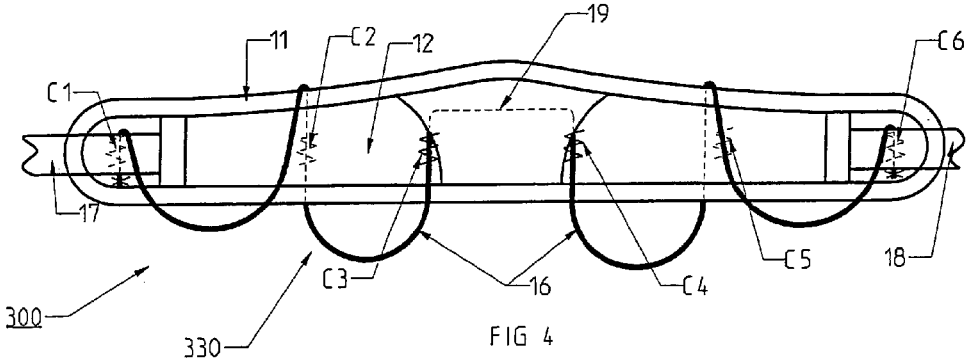

In the three alternative embodiments of belts 100, 200 and 300 illustrated in FIGS. 2 to 4, the same reference numbers will be used to denote identical or similar parts to those of FIG. 1. In the three alternative embodiments, the mechanical strength of the first end seams C1 and C6 is greater than that of the intermediate seams C2 to C5.

With reference to FIG. 2, the fixing webbing 15 is discontinuous and stops at the level of the first end seams C1 and C6 of the cord 14 of the equipment-carrying device 130. The strength between the two ends of the webbing 15 is provided by the biases 11 via the seams C7 to C10. The second intermediate seams C2 to C5 of the cord 14 for forming the loops 16 are made directly on the lining structure 12. The serial connection of successive loops 16 is advantageously fixed under the seam of the biases 11 at the level of the top edge of the belt 100.

The belt 200 of FIG. 3 is similar to that of FIG. 2, the only difference being the serial connection of certain loops 16 of the equipment-carrying device 230 which passes over the top biases 11.

The belt 300 of FIG. 4 is similar to that of FIG. 3, the only difference being the median serial connection 19 of the intermediate loops of the equipment-carrying device 330, which is not fixed under the seam of the biases but is located directly in contact with the lining structure 12.

Figure 5:
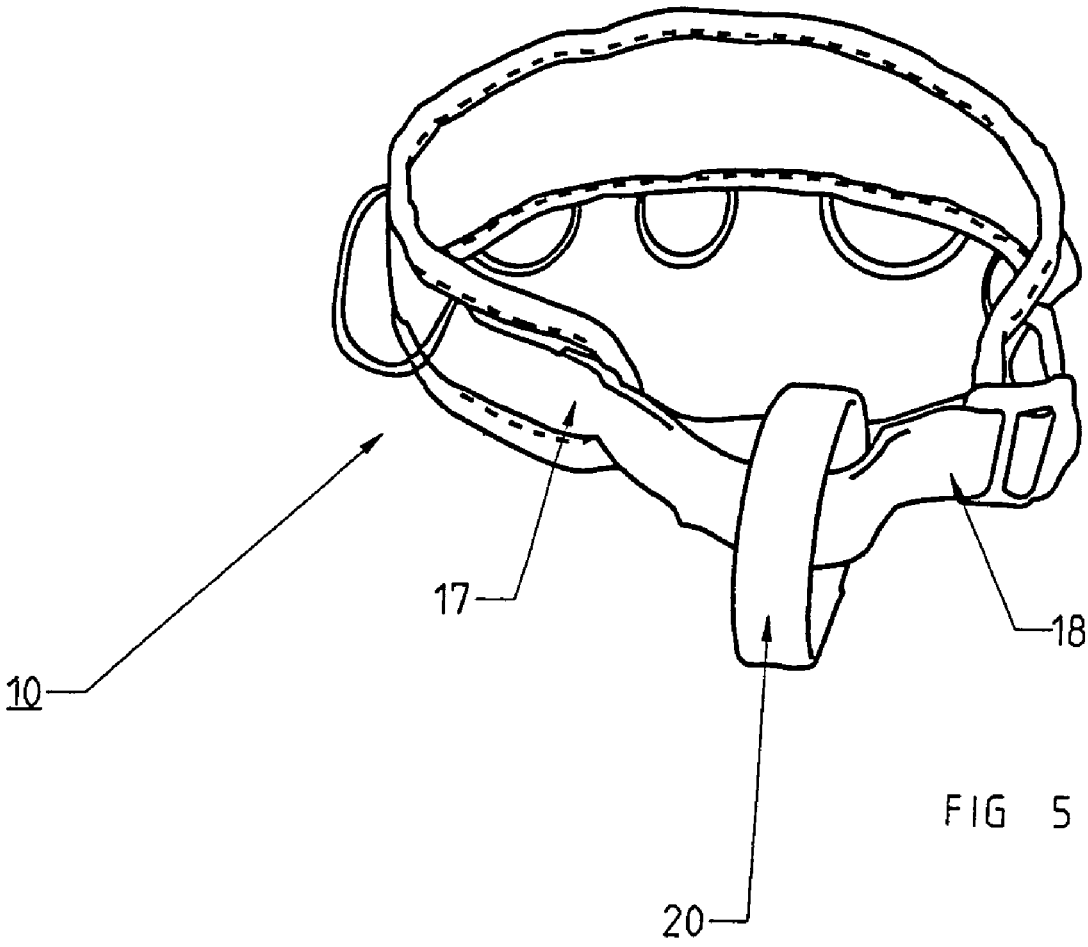
FIG. 5 represents a perspective view of the belt according to FIG. 1, with its attachment system.

FIG. 5 represents the belt of FIG. 1 with two ends 17, 18 of the webbing 15 attached to attachment means 20 designed to be attached to the belaying cord.

The invention claimed is:

1. A roping belt comprising:

a lining structure;

an equipment-carrying device including a continuous cord fixed by seams along the lining structure so as to form a succession of attachment loops; and attachment means arranged at a front of the belt, wherein:

both distal ends of the cord are securedly attached to the belt by first end seams structured to have a strength that withstands a tearing force of 4 kN or greater to thereby support a weight of a man, a strength of second intermediate seams that form the succession of the attachment loops being less than the strength of the first end seams, and two successive loops of the equipment-carrying device are fixed under a seam of biases at a level of a top edge of the belt that is opposite from a bottom edge of the belt and the attachment loops hang from the bottom edge when the roping belt is worn by a user.

2. The roping belt according to claim 1, wherein the lining structure is strengthened by biases sewn edgewise along a periphery.

3. The roping belt according to claim 1, wherein the cord of the equipment-carrying device is securedly attached by the first and second seams to a continuous fixing webbing extending over the whole length of the lining structure.

4. The roping belt according to claim 1, wherein the cord of the equipment-carrying device is connected to the first end seams by attaching two ends of a discontinuous webbing with the attachment means.

5. The roping belt according to claim 4, wherein the second intermediate seams of the cord are arranged on the lining structure.

6. The roping belt according to claim 1, wherein two successive loops of the equipment-carrying device are connected in contact with the lining structure.

7. The roping belt according to claim 1, wherein the second intermediate seams comprise a plurality of separate individual seams, each of the separate individual seams corresponding to a single loop end of the cord and being disconnected from remaining ones of the individual seams.

* * * * *